United States Patent [19]

Edin

[11] Patent Number: 4,757,903

[45] Date of Patent: Jul. 19, 1988

[54] ARRANGEMENT FOR FEEDING VALUABLE DOCUMENTS TO A STORAGE SPACE

[75] Inventor: Gösta N. Edin, Ronninge, Sweden

[73] Assignee: Inter Innovation AB, Stockholm, Sweden

[21] Appl. No.: 881,308

[22] Filed: Jul. 2, 1986

[30] Foreign Application Priority Data

Aug. 1, 1985 [SE] Sweden ..... 8503667

[51] Int. Cl.[4] ..... B07C 5/34; B07C 5/36

[52] U.S. Cl. ..... 209/534; 235/379; 271/184; 271/208; 271/225

[58] Field of Search ..... 209/534; 194/205–207; 235/379; 271/3, 3.1, 4, 9, 180, 184, 185, 208, 225

[56] References Cited

U.S. PATENT DOCUMENTS 3,360,099 12/1967 Barr ..... 271/184 X 3,988,019 10/1976 Achelpohl ..... 271/184 X

FOREIGN PATENT DOCUMENTS 1055449 4/1959 Fed. Rep. of Germany ..... 198/367

1550993 6/1967 France ..... 271/184

*Primary Examiner*—Robert B. Reeves

*Assistant Examiner*—Edward M. Wacyra

*Attorney, Agent, or Firm*—Sughrue, Mion, Zinn, Macpeak and Seas

[57] ABSTRACT

An arrangement for feeding banknotes includes a gripping device for transferring the notes from one part of a transport path to another part. The gripping device comprises two coacting rollers 174,174', of which one 174 is journalled in a movable bridge 175 which, in turn, is journalled in a movable link element 173. One of two co-acting wheels 171,172 is also journalled in the link element and can be moved away from the remaining wheel 172 in dependence on the passage of notes in the transport path. Upon transportation of a note to the gripping device, and in dependence on the output from a detector 121, the link element 173 with the bridge 175 is first rotated through a short distance, wherewith the wheels 171, 172 no longer co-act with one another, whereafter the bridge is rotated through a short distance in relation to the link element causing the rollers 174, 174' to co-act with one another.

1 Claim, 4 Drawing Sheets

121
14
10
18
16
13
122
11
17
123
133
131
132
15

10
11
18
17
201
202
203
205
260
2601
270
2701
22
204
2704
2604
21
2702
2602
233
230
250
2603
2703
23
10'
232
231
10
241
24
28
26
2705
27
2605
26'
27'

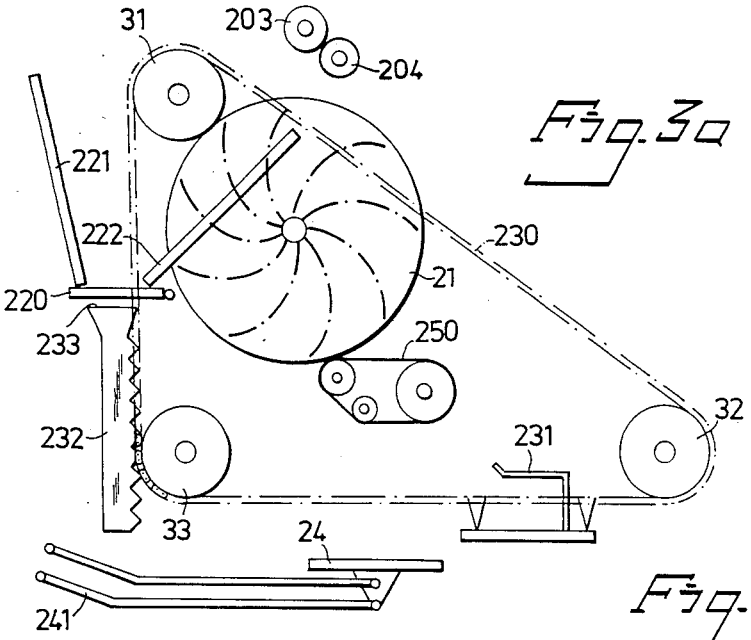
Fig. 3a
Fig. 3d
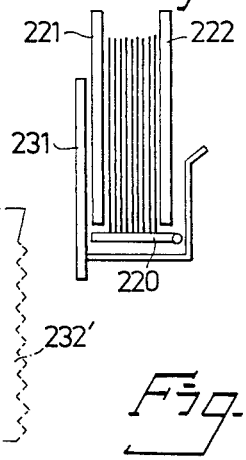
Fig. 3b
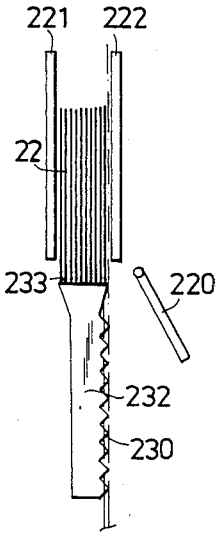
Fig. 3c
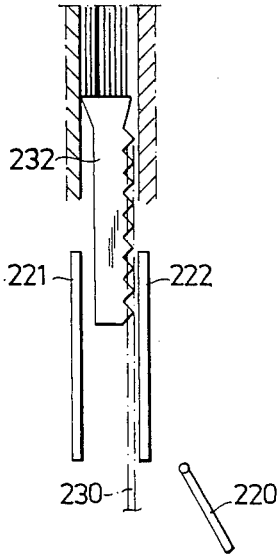
Fig. 3e
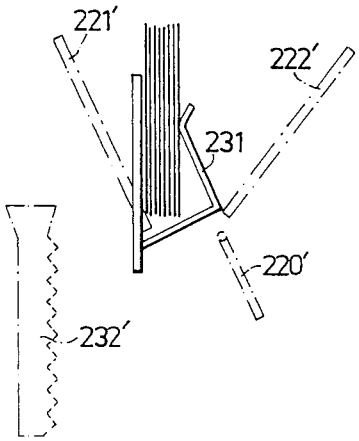

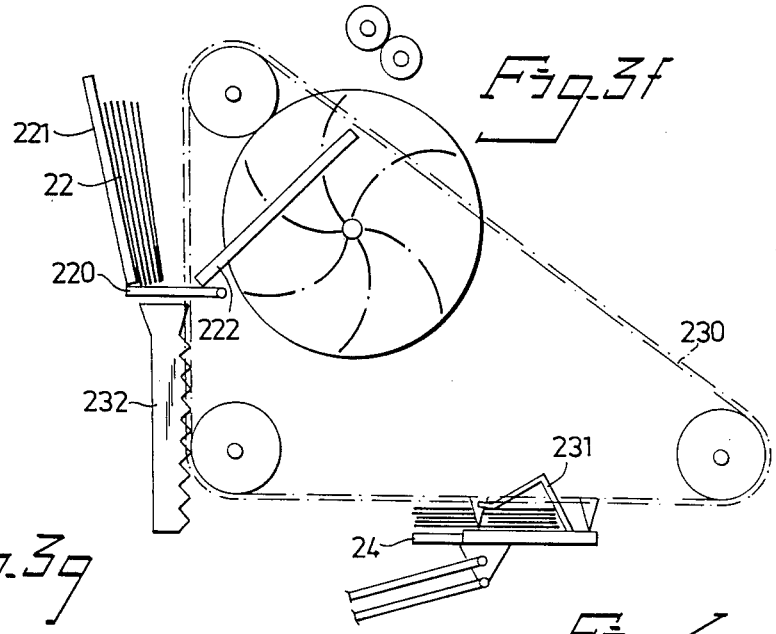
Fig. 3f
Fig. 3g
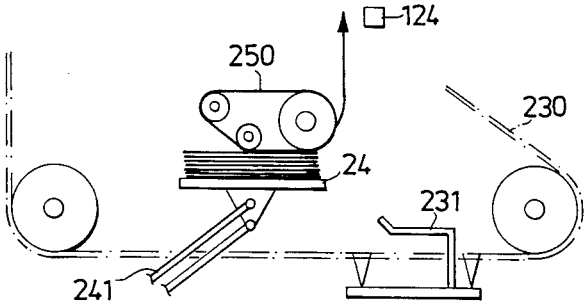
Fig. 4a
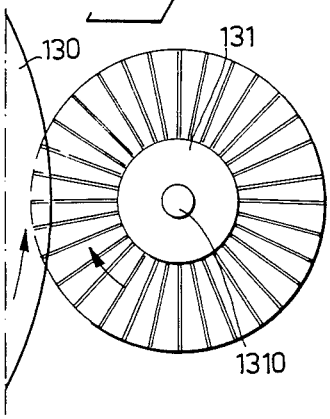
Fig. 4b
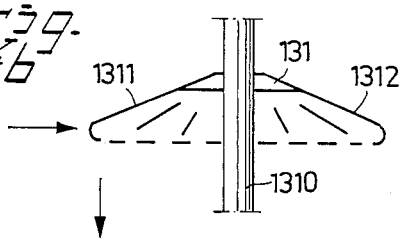
Fig. 4c
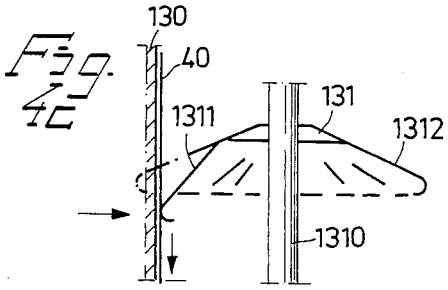
Fig. 4d
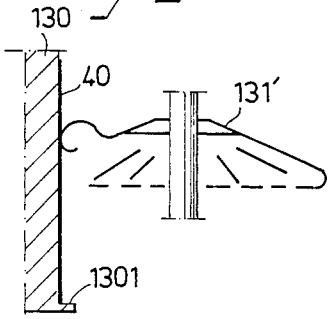

ARRANGEMENT FOR FEEDING VALUABLE DOCUMENTS TO A STORAGE SPACE

TECHNICAL FIELD

The present invention relates to an arrangement for feeding valuable documents such as banknotes, cheques, etc., from an externally accesible infeed opening to a storage space.

BACKGROUND PRIOR ART

Combined banknote infeed and outfeed arrangements are previously known, for example, from U.K. patent specification No. 2 094 531.

In this arrangement a customer inserts a bundle of banknotes, which are then transported, one after the other, past a detecting means and from there to temporary storage locations for banknotes of differing denominations. Subsequent to the customer acknwledging his satisfaction with the depositing procedure, the documents are conveyed further to respective banknote/collecting boxes. These banknotes can then be dispensed to other customers, therewith minimizing the number of banknotes with which the apparatus need be filled in order to meet a plurality of transactions.

A similar arrangement is illustrated and described in European patent application No. 024 704, in which a bundle of banknotes inserted into the arrangement by a customer is fed, in a similar manner, to temporary collecting locations for differing banknote denominations, or to a separate collecting chamber for banknotes of all denominations. The banknotes can then be sorted from this separate or general collecting chamber into the aforesaid banknote collecting locations.

An arrangement of somewhat different construction is described and illustrated in U.S. Pat. No. 4,253,016. This arrangement also pertains to a combined infeed and outfeed arrangement, although in this case the various banknotes in the inserted bundle are transported to one single magazine or, if the customer changes his/her mind, to the withdrawal opening of the arrangement, via transport means provided in both the infeed and outfeed arrangement.

The aforementioned arrangement and similar arrangements, are often complicated and bulky, and are not sufficiently flexible for use under different conditions. However, a major drawback with the aforesaid known arrangements is that they are too slow in operation to meet the requirements placed on such arrangements under present day circumstances.

SUMMARY OF THE INVENTION

The object of the invention is to provide an arrangement of the aforesaid kind with which the aforementioned drawbacks are eliminated, and particularly to such an arrangement which will operate reliably and quickly so as to shorten the queues which present day cashpoints or autobanks tend to generate. This is achieved in that the gripping means comprises a movable link element having a wheel or the like and a movable bridge which is journalled in the link element and provided with a roller or the like therewith to ensure that the position of a valuable document is fully controlled during transportation and that the document, nevertheless, can be transferred from one part of the transport path to another part thereof while being turned through about 90° in a fully controllable manner, i.e. normally without risk of the document being torn or smashed.

BRIEF DESCRIPTION OF THE DRAWINGS

The invention will now be described in more detail with reference to the accompanying schematic drawings, in which.

Figure 1:
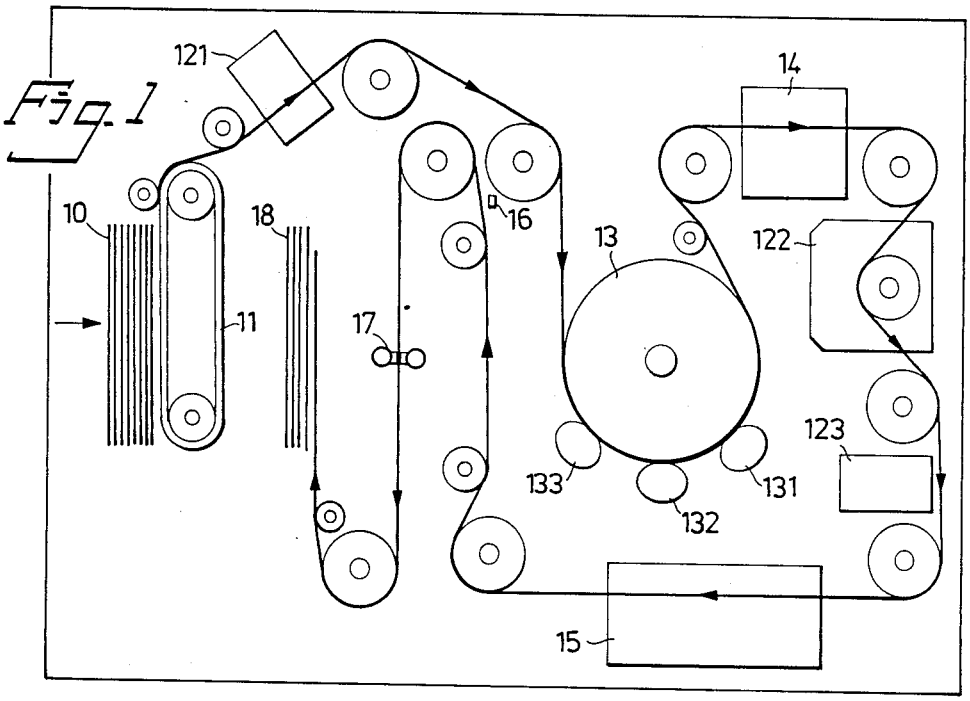
FIG. 1 is a top plan view of an upper part of an arrangement according to the invention.
Figure 2:
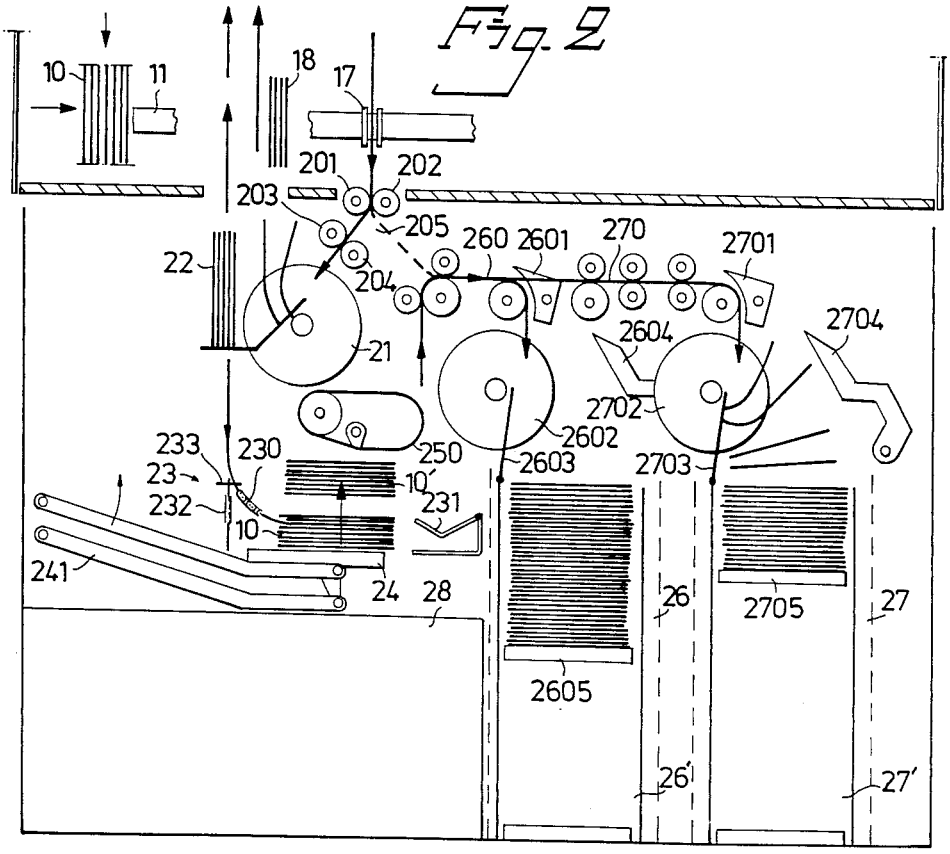
FIG. 2 is a side view of a lower part of the arrangement illustrated in FIG. 1.
Figure 5:
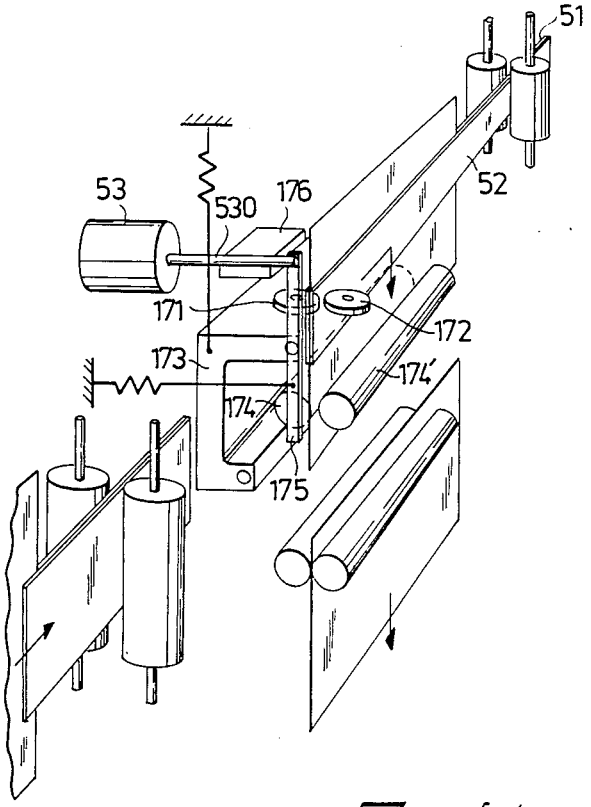

FIGS. *3a–3g* illustrate transport means incorporated in the arrangement illustrated in FIGS. 1–2, showing a sequence of different operational modes;

FIGS. *4a–4d* illustrate a document straightening or aligning means;

FIG. 5 illustrates gripping means for moving valuable documents from the upper part of the arrangement to the lower part thereof; and FIGS. *6a–6b* illustrate elements located in the vicinity of an infeed opening.

DESCRIPTION OF A PREFERRED EMBODIMENT

An infeed arrangement according to the invention includes two preferably superposed parts, of which the upper part, i.e. the processing part, incorporates an infeed opening 61, an outfeed opening 62 for documents which might be returned to the customer or cashier, detecting means 121, 122, 123, and a part of a transport path.

The lower part of the arrangement includes, inter alia, cassettes 26',27', a collecting location 22, the remainder of the transport path, and feed means 24 located between the collecting location 22 and the cassettes 26',27'. The aforesaid parts of the arrangement may also be placed side-by-side.

A bundle 10 of documents placed in the infeed opening 61 by a customer or cashier is manipulated by a feed mechanism 11 in a known manner (FIG. 1) to feed the documents singly in their longitudinal direction (short end first) into a transport path, comprising rollers, belts, guide rails, etc., at a rate of about 10 documents per second, causing the documents to pass detectors 121,122,123, which examine each document in order to ascertain its value and whether it is genuine or not; document straightening or aligning means 13 for straightening the documents and bringing them into correct alignment prior to passing a size-measuring device 14; a printing means 15 for the optimal printing of data on certain types of document, e.g. cheques; a guide and control means 16 for establishing the passage of respective documents and for controlling a subsequent gripping means 17 operative in transferring documents from the transport path in the upper part of the arrangement to the transport path in the lower part thereof, in dependence on the result obtained from the detectors 121, 122, 123 for establishing the denominational value of the document and its genuiness, and in dependence on the action of the guide and control means 16. Documents which pass the gripping means 17 without being transferred to the transport path in the bottom part of the apparatus are passed to a re-feed or return location 18, from where they are returned to the customer.

For the sake of clarity, and to facilitate the further description of the arrangement according to the invention, no description will be made, or any illustration given, of the various rollers, belts, aligning/straightening devices etc. required in apparatus or arrangements of this kind,, since such transport path constructions are well known per se.

At the top of FIG. 2 there is illustrated a bundle of banknotes 10 placed in the arrangement, a feed mechanism 11, the aforementioned gripping means 17 and the re-feed or return location 18, in which there is located a small bundle of documents to be returned to the customer or cashier.

A document which has been found to be genuine and its value established by the detecting means 121–123 is gripped by the gripping means 17 and transferred, in its transverse direction (long side first), from the transport path in the upper part of the arrangement to the transport path in the lower part thereof, the beginning of which transport path is represented by mutually coacting rollers 201–202, 203–204. The sequentially incoming series of documents are bundled together in a collecting location 22 by a stacker wheel 21. When all the documents in a bundle have been collected in the collecting location—with the possible exception of rejected documents, which are always located in the refeed or return location 18—the machine awaits further instructions. If the customer does not wish to proceed with his/her deposit, the bundle is returned to the outfeed opening by means of a transport device comprising, for example, a reciprocatingly movable roller chain 230 and a toothed arm 232 having a plate 233. The roller chain, which follows an arcuate path, is driven clockwise, therewith engaging the toothed arm 232 and lifting the same vertically, together with the plate 233, into abutment with the pivotable bottom of the collecting location. The bottom of the collecting location is then swung to one side, and as the roller chain continues to move, the bundle of documents is lifted up through the upper part of the arrangement, and deposited in the outfeed opening.

Should the customer wish to finalize the infeed, or depositing, procedure, the toothed arm 232 is not raised but is moved to one side.

Instead, a gripping means 231 attached to the roller chain 230 is moved upwardly and to the left into the aforesaid collecting location, and grips the bundle of documents located therein, whereafter the pivotable bottom of the collecting location 22 is moved to one side and the bundle is moved by the roller chain, downwardly and to the right, and deposited on a feed means 24. Subsequent to this transfer of the document bundle, so that the collecting location is empty, and subsequent to returning the bottom of the collecting location to its starting position, the arrangement is clear for handling the next bundle of documents, despite the fact that the documents contained in the preceding bundle have still not yet reached their respective final destinations, i.e. have not yet been fed into the respective cassettes.

Due to the particular construction and action of the gripping means 23, there is afforded the additional advantage that the bundle formed by the stacker wheel 21 in the collecting location, and given an even side surface against the bottom of said location, i.e. all documents flush along at least one side of the bundle, is transported and delivered to the feed means 24 while retaining the said smooth side surface of the bundle, this side surface being its leading side surface, which is a basic prerequisite for correct outfeeding of the documents by means of the belt conveyor 250, particularly when the bundle contains a mixture of documents of various dimensions (banknotes of different denominations and size).

The feed means 24 has a lifting device 241 arranged for rapid lifting of the feed means with a bundle of documents thereon through a distance corresponding to a suitable lifting height for a bundle containing a given number of documents, e.g. 100, and thereafter for successively lifting the bundle through distances corresponding to the documents fed to the transport path. FIG. 2 illustrates how a document bundle 10 has been moved upwards, in the direction of the arrow, to a position 10' adjacent a belt conveyor 250 at the input of the transport path leading to the cassettes in the storage locations 26,27. Each of the cassettes incorporated in the storage locations 26,27, which are of modular construction, is provided with its respective individual infeed means 260 and 270, which together form the terminus of the transport path. The documents are guided down into the correct cassette, according to value and type, by respective gates 2601 and 2701 located in the transport path. The gates are supplied with control signals from the size-measuring means 14. The infeed means include respective stacker wheels 2602 and 2702, from which documents are cleared with the aid of the raised lid 2603 or 2703 of respective cassettes. Each cassette has an associated, separate packing means 2604, 2704 which, upon completing each infeed procedure with respect to a complete bundle, is rotated counterclockwise and displaced downwardly, therewith to pack the contents of the respective cassette, while simultaneously sending a control signal to means for lowering a respective document support platen 2605 and 2705 provided in its associated cassette.

When the apparatus is to be used solely for document sorting purposes, e.g. internally within a bank, the facility affording temporary storage in the collecting location 22 is dispensed with, since no decision is required as to whether documents should be transported further or not. In this case, it is convenient to transfer the documents from the upper part of the apparatus directly to the transport path incorporating the cassette infeed means 260,270. This is effected with the aid of a path or route selector 205 arranged between the roller pairs 201–202 and 203–204. In FIG. 2 the transport route from the roll pairs is shown in full lines to the left and in broken lines to the right, corresponding respectively to a customer operated function with an initial collection of documents at the collecting location 22,and to a bank sorting function in which documents are transferred directly to the storage locations 26,27.

The devices required to issue instructions, drive the various motors, supply power to detectors and signal producing means, etc. are housed together in a compartment 28 provided in the bottom part of the apparatus, as is also the software for controlling the various functions of the apparatus, these functions commencing with the programming of desired functions by a customer/bank official, through an instruction or command means, and the initiation of these programmed functions, e.g. by means of a keyboard, and terminating with the distribution of the documents into their respective cassettes in the manner intended, or, in exceptional circumstances, the return of rejected or non-acceptable documents to the outfeed or withdrawal opening of the apparatus.

When depositing, for example, banknotes, in the apparatus according to the invention, the modular construction of the storage locations, including the cassettes, and associated infeed devices, together with the programmable coaction between the detector means (with pattern recognition), the transport path and the cassettes, enables one to sort:

(a) banknotes of all denominations into one and the same cassette;

(b) banknotes of mutually different denomination into different cassettes;

(c) banknotes of one denomination oriented in four mutually different ways into four different cassettes, thus with the same pattern of orientation in respective cassettes.

In addition, the apparatus enables cheques to be sorted into one cassette, banknotes into another, etc.

The transport means 23 illustrated in FIG. 2 will now be described in somewhat more detail with reference to FIG. 3. The roller chain 230 is extended between three wheels 31,32,33 and firmly carries the gripping means 231. The chain 230 also co-acts with the toothed arm 232. The illustration of FIG. 3*a* shows the aforesaid elements and also illustrates walls 221 and 222 and the bottom 220 of the collecting location 22, and the belt conveyor 250, and the stacker wheel 21, the feed means 24, the walls and bottom defining the collecting location being pivotally arranged. This Figure illustrates the situation in which the collecting location is prepared for receiving documents from a bundle of documents fed into the apparatus. In this operational stage the wall 21 leans slightly to the left and serves to support documents delivered via the feed wheels 203–204 and the stacker wheel 21, these documents resting edgewise on the pivotable bottom 220 of the collecting location. The other wall 222 of the collecting location 22 is pivoted far to the right, as seen in the drawing, and constitutes in this position means for stripping from the stacker wheel 21 documents carried thereby towards the collecting location.

FIG. 3*b* illustrates the situation in which a customer does not wish to finalize a deposit transaction. In this case all the documents concerned have collected in the collecting location 22 and the walls 221 and 222 have been rotated clockwise and anticlockwise respectively to their upright positions and the bottom 220 has been rotated anticlockwise, away from the walls, so that the document now rests on the plate 233 on the toothed arm 232.

FIG. 3*c* illustrates the operational mode in which the arm 232 has been driven upwards, through the collecting location, by the roller chain 230, this movement of the arm continuing until the bundle has passed through the upper, processing part of the arrangement and protrudes slightly from the outfeed opening, from where it can be withdrawn by the customer or the cashier.

FIG. 3*d* illustrates the infeed, finalizing mode, in which the walls 221 and 222 have been moved to the same upright positions as those described with reference to FIG. 3*b*, and the gripping means 231 has been moved by the roller chain 230 to a position closely adjacent the bottom 220 of the collecting location 22, the toothed arm 232 in this case having been moved laterally to a position 232'.

FIG. 3*e* illustrates the gripping means 231 in gripping engagement with the document bundle, and the walls 221 and 222 subsequently rotated anticlockwise and clockwise respectively, to the respective positions 221' and 222', and the bottom 220 rotated anticlockwise to the position 220'. As shown in this Figure, the documents are well held together in the bundle, while retaining a smooth and even bottom bundle-surface, this flush and even placement of the bottom edges of respective documents being achieved by abutment with the bottom 220.

FIG. 3*f* illustrates the operational mode in which the gripping means 231, holding the document bundle, is moved to the feed means 24 by the roller chain 230. In this operational stage, the walls 221, 222 and the bottom 220 have been returned to their respective starting positions, illustrated in FIG. 3*a* and the bundling of a further series of documents has commenced in the collecting location 22.

In the illustration of FIG. 3*g* the roller chain has moved the gripping means 231 further to the right, to the starting position shown in FIG. 3*a*, and the lifting means 241 has lifted the feed means 24 together with the document bundle against the belt conveyor 250, this lifting of the feed means being effected rapidly. Documents can now be conveyed singly, via the infeed means 260,270, into the cassettes of the storage locations 26,27. In this case the bundle is raised towards the conveyor in dependence on the valuable documents dispensed to the transport path, the lifting means 241 acting in response to control impulses produced by a detector means 124 on the input side of the storage locations 26,27.

The straightening or aligning means 13 illustrated in FIG. 1 will now be described in slightly more detail with reference to FIG. 4. As shown in FIG. 1, the means 13 comprises a cylindrical drum, referenced 130 in FIG. 4, against which bear three alignment wheels 131, 132, 133 the peripheries of which are slotted radially to provide a plurality of finger-like elements which are relatively rigid in the peripheral direction and relatively slender in the radial direction. Arranged immediately beneath the wheels 131–133 are further aligning wheels which are carried on the same shaft as the wheels 131–133, the further aligning wheel 131' being shown.

FIG. 4*a* is a plan view of part of the drum 130 and the aligning wheel 131. The wheel 131 is carried on a shaft 1310, which extends parallel with the drive shaft (not shown in FIG. 4*a*) of the drum 130.

As shown in FIG. 4*b*, the aligning wheel 131 has a circular conical shape. Two of the finger-like elements are illustrated, and referenced 1311 and 1312. The horizontal arrow indicates a force which acts upon the finger-like element 1311 when brought into abutment with the drum 130 as the wheel rotates. During this rotation of the wheel, the aforesaid force causes a part of the finger-like element to twist downwards, provided that there is located between the drum 130 and the finger-like element 1311 a document which can be displaced (twisted) downwardly, i.e. a document which lies incorrectly, or out of alignment, in the path.

This situation is illustrated in FIG. 4*c*. The finger-like element 1311 is shown to be deflected downwards, carrying with it the interlying document 40. When the finger-like element 1311 has passed beyond the drum 130, it returns to the position shown in FIG. 4*b*. If the document is still not positioned correctly in the transport path (with the long sides horizontal) the next finger-like element will make a corresponding positional adjustment. When the document has been brought into correct alignment with the transport path, by which is meant that one long side of the document lies against a lower slide surface 1301 on the drum 130, a passing finger-like element can no longer be bent downwards, but is instead displaced radially inwards, as indicated in FIG. 4*d* with the wheel 131', which is the lowermost and final wheel when seen in the transport direction past the drum 130. It is important that both the drum 130 and the document aligning wheels 131–133 and 131'–133a are directly driven on their respective shafts, thereby to eliminate to a large extent the risk of faulty feeding.

The gripping means 17 illustrated in FIG. 2 will now be described in more detail with reference to FIG. 5. The gripping means comprises two mutually co-acting wheels or like elements 171,172, the rotational axes of which are roughly at right angles to the movement direction of the transport path shown by the lower, lefthand arrow, two mutually co-acting rollers or like elements 174,174', the rotational axes of which are substantially parallel with the direction of movement of the transport path, a movable link 173, in which the wheel 171 is journalled, and a bridge element 175 which is movably journalled to the movable link 173 and in which the roller 174 is journalled.

At the site of the gripping means 17, the transport path comprises two movable belts 51,52 which lie loosely in abutment with one another and between which documents are transported, either to the refeed or return location 18, or from the upper arrangement part (the processing part) to the lower arrangement part, in response to the control signals received from the guide and control means 16.

When returning documents to the return location 18, the wheels 171,172 press the belts 51,52 against one another and the rollers 174,174' are located a certain distance apart, and documents are transported in the direction shown by the lower, left-hand arrow.

When documents are to be transported to the lower part of the arrangement, the control means 16 sends a signal to a solenoid 53, which attracts the bridge 175 and therewith the link 173, thus breaking the co-action between the wheels 171 and 172. During its movement towards the solenoid 53, the link 173 comes into contact with a stop 176, whereupon solely the bridge 175 is rotated, to some slight extent, thereby bringing the roller 174 into co-action with the roller 174'. The document located between the rollers at that particular moment will then be transported in a direction at right angles to the belts 51,52, as shown by the bent arrow at the top of the Figure. Not only is the document transported in a different direction, but it also changes from being transported lengtwise (a short side first) to being transported sideways (a long side first). The time over which the solenoid is energized is adapted so that the rollers 174,174' remain active for a period sufficiently long for the document to be pulled out transversely from between the belts and transported to the lower arrangement part. The various components of the gripping means then return to their respective starting positions.

The co-action between the rollers 174,174' is initiated with the aid of signals (impulses) from the aforesaid measuring means 16 precisely at that moment when the centre-point normal of a document is located at a predetermined point on the transport path, which results in a well centred position for all valuable documents—irrespective of individual lengths—during their transportation in the lower part of the arrangement, up to the storage locations, which further ensures correct document feed.

Figure 6B:
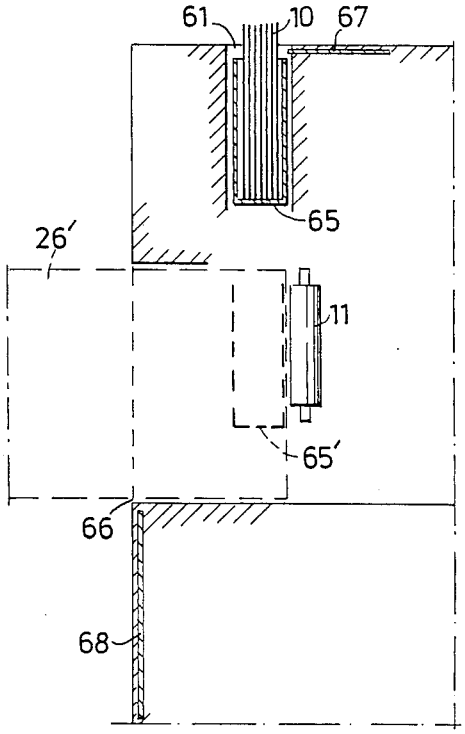
Figure 6A:
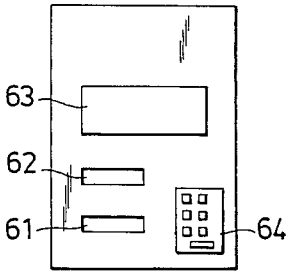

FIG. 6a is a schematic view of the apparatus from above, and illustrates the infeed opening 61, the outfeed opening 62, a lamp and display screen or panel 63, and command means (keyboard) 64 for operating (controlling) the arrangement.

FIG. 6b is a sectional side view of a portion of the uppermost part of the arrangement, and illustrates the infeed opening 61 for top feeding a bundle of documents; a further infeed opening 66 for sideways feeding of documents from cassette 26', and feed mechanism 11, which is used both for bundle infeed and for cassette infeed respectively.

Bundle infeed implies that the customer places a bundle of valuable documents (banknotes) into a feed box 65 from above, this box being located in an upper position, shown in full lines in the Figure. The infeed opening is optionally covered initially by a horizontal cover plate 67, which is moved automatically to one side, when the customer punches a code on the keyboard 64.

When the customer presses the start button on the keyboard 64, the box 65 is moved down to the position shown in broken lines, adjacent the feed mechanism 11, and therewith initiates the procedure of ascertaining the denominational value of the respective banknotes and whether they are genuine or not, etc. The result of this examining procedure, together with any questions (commands) which might be asked of the customer is, or are, displayed on the table or screen 63, and the transactional procedure continues in the manner aforedescribed.

Cassette infeed implies that a bank employee (optionally a customer) places a cassette 26' from one side into the opening 66, which is initially covered by a plate 68 which, similar to the aforementioned cover plate 67, is moved to one side, for example when punching a given code into the keyboard 64. When the cassette has been inserted to a locked position, the cassette is automatically opened and the valuable papers contained therein fed into the apparatus by means of the feed mechanism 11.

I claim:

1. An arrangement for feeding valuable documents, such as banknotes or cheques, from an externally accessible infeed opening (61, 66) to a document storage space (26, 27), comprising:

(a) detecting means (121, 122, 123) located in proximity to a transport path extending between the infeed opening and said document storage space for examining documents which pass sequentially in series along the transport path and for controlling the transportation of the documents within the arrangement, and (b) gripping means (17) located downstream of the detecting means for transferring documents from one part of the transport path to another part thereof in response to outputs from the detecting means, (c) the transport path comprising two loosely and mutually abutting movable belts (51, 52) disposed at the site of the gripping means, and (d) the gripping means comprising:

(1) two mutually co-acting rollers (174, 174') disposed flanking the transport path and just below the belts, and having rotational axes parallel with the direction of the transport path immediately before the gripping means, (2) two mutually co-acting wheels (171, 172) disposed flanking the belts and having rotational axes perpendicular to the transport direction of the transport path immediately before the gripping means, (3) a link (173) mounted on one side of the transport path and movable laterally thereof, one of said wheels (171) being journalled in said link for movement therewith toward and away from the belts, (4) an elongate bridge (175) journalled intermediate ends thereof in said link and movable laterally of the transport path, one of said rollers (174) being journalled in said bridge proximate one end thereof for movement therewith toward and away from the transport path, (5) stop means (176) for limiting the movement of the link away from the transport path, and (6) actuator means (53, 530) coupled to the bridge proximate another, opposite end thereof for selectively moving said opposite end such that the link (173) with the bridge (175) is first rotated through a short distance from a rest position into abutment with the stop means (176) to attendantly move said one wheel (171) out of contact with the belts (51, 52), whereafter the bridge is rotated through a short distance in relation to the link to attendantly bring said one roller (174) into co-action with the remaining roller (174').

* * * * *